US010857420B2

(12) United States Patent
Lagree

(10) Patent No.: US 10,857,420 B2
(45) Date of Patent: Dec. 8, 2020

(54) END PLATFORM FOR AN EXERCISE MACHINE

(71) Applicant: Lagree Technologies, Inc., Burbank, CA (US)

(72) Inventor: Sebastien Anthony Louis Lagree, Burbank, CA (US)

(73) Assignee: Lagree Technologies, Inc., Chatsworth, CA (US)

( * ) Notice: Subject to any disclaimer, the term of this patent is extended or adjusted under 35 U.S.C. 154(b) by 7 days.

(21) Appl. No.: 16/202,330

(22) Filed: Nov. 28, 2018

(65) Prior Publication Data

US 2019/0160329 A1 May 30, 2019

Related U.S. Application Data

(60) Provisional application No. 62/591,549, filed on Nov. 28, 2017.

(51) Int. Cl.
*A63B 22/00* (2006.01)
*A63B 21/00* (2006.01)
(Continued)

(52) U.S. Cl.
CPC .... *A63B 22/0089* (2013.01); *A63B 21/00065* (2013.01); *A63B 21/023* (2013.01);
(Continued)

(58) Field of Classification Search
CPC ..... A63B 21/0012; A63B 21/055; A63B 21/00098; A63B 21/00101;
(Continued)

(56) References Cited

U.S. PATENT DOCUMENTS 3,770,267 A 11/1973 McCarthy
4,759,540 A 7/1988 Yu
(Continued)

FOREIGN PATENT DOCUMENTS

WO WO 2004/096376 11/2004

OTHER PUBLICATIONS https://web.archive.org/web/20100501142110/http:/spxfitness.com/index.php?option=com_content&view=article&id=32&Itemid=3; May 1, 2010 SPX Fitness Superformer Webpage Screenshot.
Pictures of Megaformer M3 Exercise Machine; Dec. 15, 2012.

*Primary Examiner* — Garrett K Atkinson
*Assistant Examiner* — Zachary T Moore
(74) *Attorney, Agent, or Firm* — Neustel Law Offices

(57) ABSTRACT

An End Platform for an Exercise Machine for increased support of an exerciser's spine, neck and head which allows for an expanded scope of exercises that cannot otherwise be performed on the machine without the improved platform. The End Platform for an Exercise Machine generally includes a novel, ergonomically improved stationary platform affixed to at least one opposed end of a substantially longitudinal exercise machine that includes at least a resistance biased reciprocating platform. The improved end platform provides for increased support of exercisers' spine, neck and head, thereby allowing for an expanded scope of exercises that cannot otherwise be performed on the machine without the improved platform, and further provides for the attachment of new and novel exercise equipment accessories to the exercise machine.

18 Claims, 9 Drawing Sheets

(51) Int. Cl.

| | |
|---|---|
| ***A63B 21/068*** | (2006.01) |
| ***A63B 23/12*** | (2006.01) |
| ***A63B 23/035*** | (2006.01) |
| ***A63B 21/055*** | (2006.01) |
| ***A63B 22/20*** | (2006.01) |
| ***A63B 21/02*** | (2006.01) |
| ***A63B 71/06*** | (2006.01) |

(52) U.S. Cl.

CPC ..... *A63B 21/0552* (2013.01); *A63B 21/068* (2013.01); *A63B 21/153* (2013.01); *A63B 21/4035* (2015.10); *A63B 21/4045* (2015.10); *A63B 22/0023* (2013.01); *A63B 22/203* (2013.01); *A63B 22/205* (2013.01); *A63B 22/208* (2013.01); *A63B 23/03508* (2013.01); *A63B 23/12* (2013.01); *A63B 71/06* (2013.01); *A63B 2071/0694* (2013.01); *A63B 2208/0219* (2013.01); *A63B 2208/0242* (2013.01); *A63B 2208/0252* (2013.01); *A63B 2225/093* (2013.01)

(58) Field of Classification Search

CPC ..... A63B 21/4035; A63B 21/4045; A63B 21/023; A63B 21/0428; A63B 21/00065; A63B 21/02; A63B 21/04; A63B 21/0407; A63B 21/40; A63B 21/4027; A63B 21/4033; A63B 21/4039; A63B 21/4041; A63B 22/0076; A63B 22/0087; A63B 22/20; A63B 22/201; A63B 22/203; A63B 22/02; A63B 22/04; A63B 22/06; A63B 22/0605; A63B 22/0664; A63B 22/0676; A63B 2208/0219; A63B 2209/02

See application file for complete search history.

(56) References Cited

U.S. PATENT DOCUMENTS

| | | | | |
|---|---|---|---|---|
| 4,798,378 | A | 1/1989 | Jones | |
| 4,911,438 | A | 3/1990 | Van Straaten | |
| 5,066,005 | A | 11/1991 | Luecke | |
| 5,263,913 | A | 11/1993 | Boren | |
| 5,358,462 | A | 10/1994 | Calderone | |
| 5,429,567 | A | 7/1995 | Gerschefske | |
| 5,833,588 | A | 11/1998 | Connelly, III | |
| 5,885,197 | A | 3/1999 | Barton | |
| 5,967,955 | A | 10/1999 | Westfall | |
| 5,997,450 | A | 12/1999 | Wilkinson | |
| 6,179,753 | B1 | 1/2001 | Barker | |
| 7,163,500 | B2 | 1/2007 | Endelman | |
| 7,803,095 | B1 | 9/2010 | Lagree | |
| 8,641,585 | B2 | 2/2014 | Lagree | |
| 9,138,606 | B2 | 9/2015 | Lagree | |
| 9,415,253 | B2 * | 8/2016 | Lagree | A63B 23/03516 |
| 2001/0056011 | A1 | 12/2001 | Endelman | |
| 2003/0119635 | A1 | 6/2003 | Arbuckle | |
| 2004/0142800 | A1 | 7/2004 | Gerschefske | |
| 2005/0085357 | A1 | 4/2005 | Endelman | |
| 2005/0124471 | A1 | 6/2005 | Wilkinson | |
| 2006/0046914 | A1 | 3/2006 | Endelman | |
| 2006/0199712 | A1 | 9/2006 | Barnard | |
| 2007/0117693 | A1 | 5/2007 | Llioi | |
| 2007/0129226 | A1 | 6/2007 | Leavitt | |
| 2007/0219053 | A1 | 9/2007 | Barufka | |
| 2008/0070765 | A1 | 3/2008 | Brown | |
| 2008/0248935 | A1 | 10/2008 | Solow | |
| 2009/0111661 | A1 | 4/2009 | Hauser | |
| 2010/0227748 | A1 | 9/2010 | Campanaro | |
| 2011/0130258 | A1 | 6/2011 | Gerschefske | |
| 2011/0166002 | A1 | 7/2011 | Savsek | |
| 2011/0172069 | A1 | 7/2011 | Gerschefske | |
| 2012/0295771 | A1 | 11/2012 | Lagree | |
| 2014/0011645 | A1 | 1/2014 | Johnson | |
| 2014/0100089 | A1 | 4/2014 | Kermath | |
| 2014/0121076 | A1 | 5/2014 | Lagree | |
| 2014/0121078 | A1 | 5/2014 | Lagree | |
| 2014/0121079 | A1 * | 5/2014 | Lagree | A63B 22/0046 482/139 |
| 2014/0141948 | A1 | 5/2014 | Aronson | |
| 2014/0221182 | A1 | 8/2014 | Lin | |
| 2015/0024914 | A1 * | 1/2015 | Lagree | A63B 22/0089 482/142 |
| 2015/0057127 | A1 | 2/2015 | Lagree | |
| 2015/0065318 | A1 * | 3/2015 | Lagree | A63B 22/0087 482/130 |
| 2015/0065320 | A1 | 3/2015 | Anderson | |
| 2015/0072841 | A1 | 3/2015 | Lagree | |
| 2015/0141204 | A1 | 5/2015 | Lagree | |
| 2015/0217164 | A1 | 8/2015 | Lagree | |
| 2015/0220523 | A1 | 8/2015 | Lagree | |
| 2015/0246263 | A1 | 9/2015 | Campanaro | |
| 2015/0297944 | A1 | 10/2015 | Lagree | |
| 2015/0343250 | A1 | 12/2015 | Lagree | |
| 2015/0360068 | A1 | 12/2015 | Lagree | |
| 2015/0360083 | A1 | 12/2015 | Lagree | |
| 2015/0360113 | A1 | 12/2015 | Lagree | |
| 2015/0364058 | A1 | 12/2015 | Lagree | |
| 2015/0367166 | A1 | 12/2015 | Lagree | |
| 2016/0008657 | A1 | 1/2016 | Lagree | |
| 2016/0059060 | A1 | 3/2016 | Lagree | |
| 2016/0059061 | A1 | 3/2016 | Lagree | |
| 2016/0096059 | A1 | 4/2016 | Lagree | |
| 2016/0166870 | A1 | 6/2016 | Lagree | |
| 2016/0193496 | A1 | 7/2016 | Lagree | |
| 2016/0256733 | A1 | 9/2016 | Lagree | |
| 2016/0271452 | A1 | 9/2016 | Lagree | |
| 2016/0311496 | A1 * | 10/2016 | Atterbury | B62K 21/125 |
| 2016/0317858 | A1 | 11/2016 | Lagree | |
| 2016/0346593 | A1 | 12/2016 | Lagree | |
| 2016/0361602 | A1 | 12/2016 | Lagree | |
| 2017/0014664 | A1 | 1/2017 | Lagree | |
| 2017/0014672 | A1 | 1/2017 | Lagree | |
| 2017/0036057 | A1 | 2/2017 | Lagree | |
| 2017/0036061 | A1 | 2/2017 | Lagree | |
| 2017/0043210 | A9 | 2/2017 | Lagree | |
| 2017/0065846 | A1 | 3/2017 | Lagree | |
| 2017/0072252 | A1 | 3/2017 | Lagree | |
| 2017/0087397 | A1 | 3/2017 | Lagree | |
| 2017/0100625 | A1 | 4/2017 | Lagree | |
| 2017/0100629 | A1 | 4/2017 | Lagree | |
| 2017/0106232 | A1 | 4/2017 | Lagree | |
| 2017/0113091 | A1 | 4/2017 | Lagree | |
| 2017/0120101 | A1 | 5/2017 | Lagree | |
| 2017/0144013 | A1 | 5/2017 | Lagree | |
| 2017/0157452 | A1 | 6/2017 | Lagree | |
| 2017/0157458 | A1 | 6/2017 | Lagree | |
| 2017/0165518 | A1 | 6/2017 | Lagree | |
| 2017/0165555 | A1 | 6/2017 | Lagree | |
| 2017/0189740 | A1 | 7/2017 | Lagree | |
| 2017/0189741 | A1 | 7/2017 | Lagree | |
| 2017/0209728 | A1 | 7/2017 | Lagree | |
| 2017/0239526 | A1 | 8/2017 | Lagree | |
| 2017/0246491 | A1 | 8/2017 | Lagree | |
| 2017/0246499 | A1 | 8/2017 | Lagree | |
| 2017/0296865 | A1 | 10/2017 | Lagree | |
| 2017/0304673 | A1 | 10/2017 | Lagree | |
| 2017/0326406 | A1 | 11/2017 | Lagree | |
| 2017/0340947 | A1 | 11/2017 | Lagree | |
| 2017/0354840 | A1 | 12/2017 | Lagree | |
| 2018/0015319 | A1 | 1/2018 | Lagree | |
| 2018/0021621 | A1 | 1/2018 | Lagree | |
| 2018/0021655 | A1 | 1/2018 | Lagree | |
| 2018/0036583 | A1 | 2/2018 | Lagree | |
| 2018/0056109 | A1 | 3/2018 | Lagree | |
| 2018/0056133 | A1 | 3/2018 | Lagree | |
| 2018/0111020 | A1 | 4/2018 | Lagree | |
| 2018/0111033 | A1 | 4/2018 | Lagree | |
| 2018/0117392 | A1 | 5/2018 | Lagree | |
| 2018/0133532 | A1 | 5/2018 | Lagree | |
| 2018/0133533 | A1 | 5/2018 | Lagree | |
| 2018/0133534 | A1 | 5/2018 | Lagree | |

(56) References Cited

U.S. PATENT DOCUMENTS

| | | | |
|---|---|---|---|
| 2018/0133542 | A1 | 5/2018 | Lagree |
| 2018/0178053 | A1 | 6/2018 | Lagree |
| 2018/0193691 | A1 | 7/2018 | Lagree |
| 2018/0250551 | A1 | 9/2018 | Lagree |
| 2018/0250573 | A1 | 9/2018 | Lagree |
| 2018/0272179 | A1 | 9/2018 | Lagree |
| 2018/0280782 | A1 | 10/2018 | Lagree |
| 2018/0318627 | A1 | 11/2018 | Lagree |
| 2018/0318646 | A1 | 11/2018 | Lagree |
| 2018/0326252 | A1 | 11/2018 | Lagree |

* cited by examiner

END PLATFORM FOR AN EXERCISE MACHINE

CROSS REFERENCE TO RELATED APPLICATIONS

I hereby claim benefit under Title 35, United States Code, Section 119(e) of U.S. provisional patent application Ser. No. 62/591,549 filed Nov. 28, 2017. The 62/591,549 application. The 62/591,549 application is hereby incorporated by reference into this application.

STATEMENT REGARDING FEDERALLY SPONSORED RESEARCH OR DEVELOPMENT

Not applicable to this application.

BACKGROUND

Field

Example embodiments in general relate to an end platform for an exercise machine for increased support of an exercisers' spine, neck and head which allows for an expanded scope of exercises that cannot otherwise be performed on the machine without the improved platform.

There has thus been outlined, rather broadly, some of the embodiments of the end platform for an exercise machine in order that the detailed description thereof may be better understood, and in order that the present contribution to the art may be better appreciated. There are additional embodiments of the end platform for an exercise machine that will be described hereinafter and that will form the subject matter of the claims appended hereto. In this respect, before explaining at least one embodiment of the end platform for an exercise machine in detail, it is to be understood that the end platform for an exercise machine is not limited in its application to the details of construction or to the arrangements of the components set forth in the following description or illustrated in the drawings. The end platform for an exercise machine is capable of other embodiments and of being practiced and carried out in various ways. Also, it is to be understood that the phraseology and terminology employed herein are for the purpose of the description and should not be regarded as limiting.

BACKGROUND

Resistance based exercise machines with a reciprocating, spring biased exercise platform have been commercially available for many years, and are well known to those in the fitness industry. For instance, various exercise machines with a spring biased substantially horizontal reciprocating platform are used to perform exercises in accordance with the teachings of the Pilates Method or the Lagree Method, both methods being practiced worldwide.

Such exercise machines comprise a substantially longitudinal structure, a platform that reciprocates on tracks or rails substantially between the opposed ends of the longitudinal structure, and a biasing means such as a plurality of springs or elastic ropes that removably attach the reciprocating platform to one end of the longitudinal structure. Exercises are performed by exerting a force against the reciprocating platform in opposition to the resistance induced against the platform by the biasing means.

The Lagree Method of exercising has, over the years, broadened to include the practice of new and novel exercises that were previously impossible to perform on traditional Pilates machines and, correspondingly continued to advance the art through innovative machine designs that provided for the performance of an ever expanding repertoire of unique, beneficial exercises, many of which are performed by an exerciser only partially positioned on the machine, and partially positioned on the floor of the exercise facility.

The Lagree Method and the Pilates Method similarly teach maintaining spinal alignment throughout the exercise routine, but substantially differ in that the history of the Pilates Method has kept the exerciser positioned almost entirely on the reciprocating platform, while the Lagree Method continually moves the exerciser from a position on the reciprocating platform to positions that require use of stationary platforms affixed at substantially the opposed ends of the longitudinal structure. However, there is a continued demand to overcome the functionality limitations of traditional exercise machines as a means to expand the scope of exercises not performable on exercise machines with end platforms of traditional geometry.

Those skilled in the art will appreciate the novelty and commercial value of an improved end platform that provides for enhanced spinal support, and for the attachment of various exercising accessories that significantly expanded the scope of exercises that could be safely and efficiently performed on the machine.

SUMMARY

An example embodiment is directed to an end platform for an exercise machine. The various embodiments described herein provide for a novel, ergonomically improved stationary platform affixed to at least one opposed end of a substantially longitudinal exercise machine that comprises at least a resistance biased reciprocating platform. The improved end platform provides for increased support of exercisers' spine, neck and head, thereby allowing for an expanded scope of exercises that cannot otherwise be performed on the machine without the improved platform, and further provides for the attachment of new and novel exercise equipment accessories to the exercise machine.

There has thus been outlined, rather broadly, some of the embodiments of the end platform for an exercise machine in order that the detailed description thereof may be better understood, and in order that the present contribution to the art may be better appreciated. There are additional embodiments of the end platform for an exercise machine that will be described hereinafter and that will form the subject matter of the claims appended hereto. In this respect, before explaining at least one embodiment of the end platform for an exercise machine in detail, it is to be understood that the end platform for an exercise machine is not limited in its application to the details of construction or to the arrangements of the components set forth in the following description or illustrated in the drawings. The end platform for an exercise machine is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Example embodiments will become more fully understood from the detailed description given herein below and the accompanying drawings, wherein like elements are represented by like reference characters, which are given by way of illustration only and thus are not limitative of the example embodiments herein.

DETAILED DESCRIPTION

Various aspects of specific embodiments are disclosed in the following description and related drawings. Alternate embodiments may be devised without departing from the spirit or the scope of the present disclosure. Additionally, well-known elements of exemplary embodiments will not be described in detail or will be omitted so as not to obscure relevant details. Further, to facilitate an understanding of the description, a discussion of several terms used herein follows.

The word "exemplary" is used herein to mean "serving as an example, instance, or illustration." Any embodiment described herein as "exemplary" is not necessarily to be construed as preferred or advantageous over other embodiments.

Figure 1:
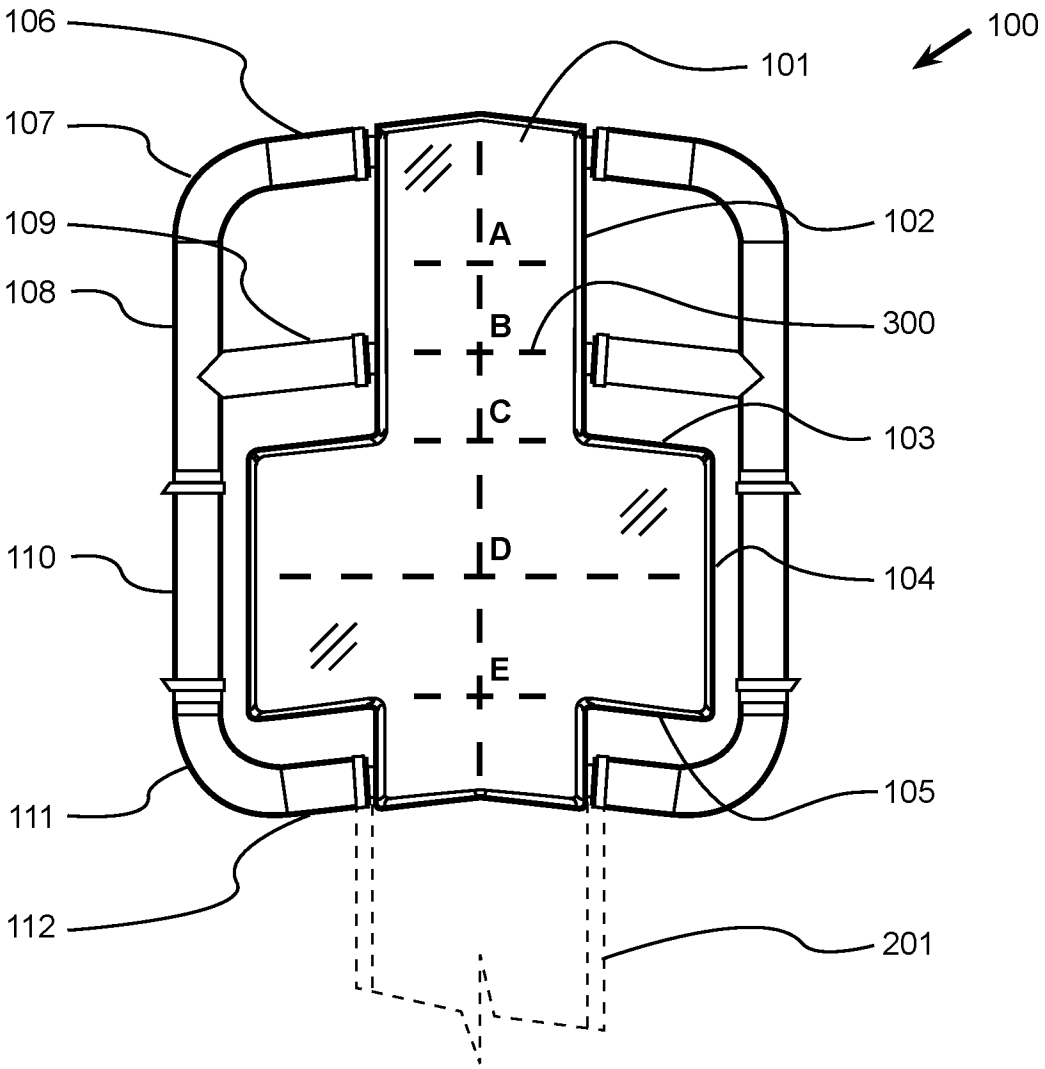
FIG. 1 is an exemplary illustration showing a top view of a longitudinal end platform with indicia.

FIG. 1 is an exemplary illustration showing a top view of a longitudinal end platform assembly 100 with indicia 300. As a point of reference, one distal end of the opposed ends of a substantially longitudinal machine structure 201 is shown as a dashed line. For clarity, and as will be used in this description, a distal end of the longitudinal end platform assembly 100 shall be the end opposed to the dashed line representing the machine structure 201, and the proximal end of the platform assembly 100 shall be the edge of the platform 101 closest to the dashed line just described. It should be noted that the end platform assembly 100 is substantially symmetrical about the central longitudinal axis of the machine 200 and the description of a functional component or feature called out in any drawing on one side of the assembly may similarly apply to the component that is mirrored on the opposed side of the central longitudinal axis of the end platform assembly 100.

The end platform assembly 100 therefore comprises a substantially longitudinal platform 101 shown with a varying geometry to be fully described herein, and handles projecting laterally from and affixed to the platform 100. As one variation, the handles may be affixed to the machine structure proximal to the longitudinal end platform 101. The platform 101 provides for a plurality of gripping surfaces that allow exercisers 400 to grasp the platform 101 in many positions to perform various exercises. The gripping surfaces may be substantially aligned with the central longitudinal axis of the exercise machine comprising a medial gripping surface 102, and a lateral gripping surface 104; with the space formed between the lateral edge of the gripping surfaces and the handles being of a sufficient dimension to allow a typical hand to be inserted so that the fingers of the hand may wrap the sides and bottom of the platform 101 for gripping.

Additional griping surfaces substantially aligned with the transverse axis of the machine 200 are provided; the gripping surfaces being a transverse gripping surface 103 and a transverse pushing surface 105. In practice, the gripping surface 103 and pushing surface 105 just described may correspondingly become a pushing surface and gripping surface dependent on whether the exerciser 400 is positioned off of and facing back towards the machine 200, or positioned on the machine 200 facing toward the distal end of the platform 101. Further, a machine 200 with a reciprocating platform resistance biased toward one given end will influence whether an exerciser 400 has to push or pull against the resistance bias as the means to move the reciprocating platform against the biasing force.

The handles 106, 107, 108, 109, 110, 111, 112, being of a preferred cross-sectional geometry to allow for easy grasping with a hand, provide for a significantly large number of gripping positions and combinations of positions as may be used for various exercises. More specifically, the handles 106, 107, 108, 109, 110, 111, 112 may comprise a distal transverse handle 106, a distal corner handle 107, a distal side handle 108, a middle transverse handle 109, a middle side handle 110, a proximal corner handle 111 and a proximal transverse handle 112. It should be appreciated that more or less handles 106, 107, 108, 109, 110, 111, 112 may be utilized in different embodiments, to suit the needs of different exercisers 400, or to accommodate different types of exercise machines 200.

The novel structure just described provides for performing numerous exercises that could not be performed before the invention of the structure in the drawing; the previous unavailability of such a structure possibly causing novice exercisers to become confused by the complexity of the many gripping surfaces when a class instructor directs them to change exercise positions. Therefore, it is preferable that various indicia 300 be provided on the end platform assembly 100 to enable an instructor to give clear and efficient direction regarding the body placement or grip positioning during exercising. The indicia 100 shown in the figures and described herein is merely exemplary and thus not meant to be limiting. The indicia 100 may include any visible material either connected to the end platform 101 or integral with the end platform 101, such as but not limited to any combination of colors, textures, indicator graphics, and alpha or numeric identifiers. The indicia 100 may comprise stickers or materials printed directly on the end platform 101. In the exemplary embodiment shown in FIG. 1, the indicia 100 are shown as comprising dotted lines and letters. The indicia 100 could in other embodiments comprise symbols, numbers, logos, drawings, or the like.

Figure 2:
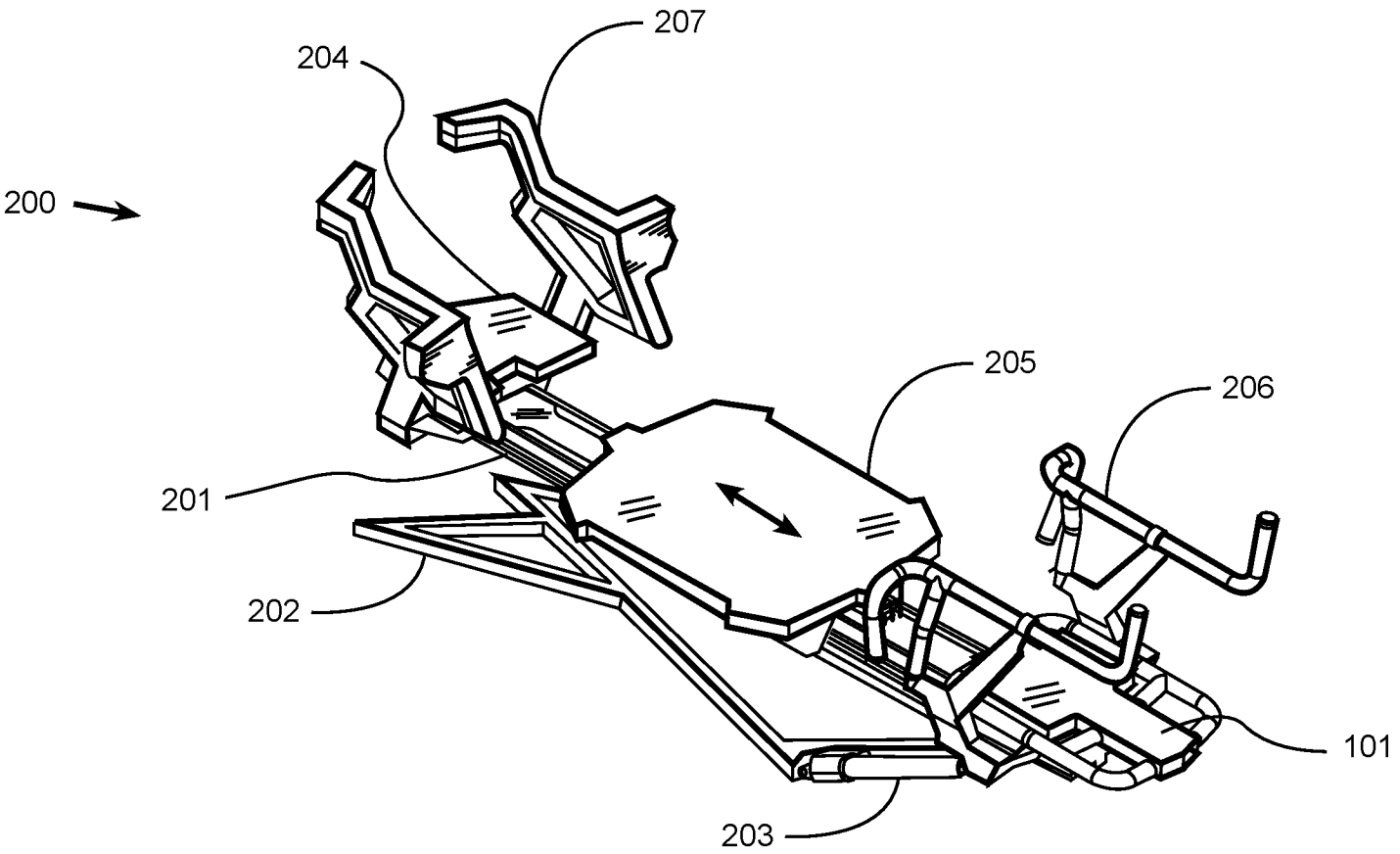
FIG. 2 is an exemplary illustration showing an isometric view of an exercise machine with a longitudinal end platform.

FIG. 2 is an exemplary illustration showing an isometric view of an exercise machine 200 with a longitudinal end platform 101; the end platform 101 being one of a plurality of components of the end platform assembly 100 previously described. In the drawing, it can be readily seen that the end platform assembly 100 is affixed at one distal end of a substantially longitudinal exercise machine 200 comprising a machine base 202, a longitudinal machine structure 201 extending substantially the length of the machine 200, a wide end platform 204, and a reciprocating platform 205 slidable along substantially the length of the machine structure 201 between the longitudinal end platform 101 and the wide end platform 204. The reciprocating platform 205 is preferably movable on a plurality of attached wheel assemblies in contact with parallel tracks aligned with the longitudinal axis of, and integral with, the machine structure 201.

One or more actuators 203 may be provided to allow one end of the machine 200 to be raised to various preferred distances above the floor to adjust an angle between the machine 200 and the ground surface. Each actuator 203 may be positioned on the opposed sides of the longitudinal axis of the machine 200; thereby providing for repositioning of the reciprocating and end platforms 101, 204, 205 along a non-horizontal plane.

It is sometimes preferred that exercisers 400 have a variety of touch points to mount or dismount the machine 200 and to stabilize during exercise. Various handle assemblies 206, 207 may be affixed to the exercise machine 200, including a front handle assembly 207, and a variation shown as a back handle assembly 206. Handle assemblies 206, 207 are shown adjacent to the wide end platform 204 or the longitudinal end platform 101. Positioning of the handle assembles 206, 207 may vary in different embodiments.

Figure 3A:
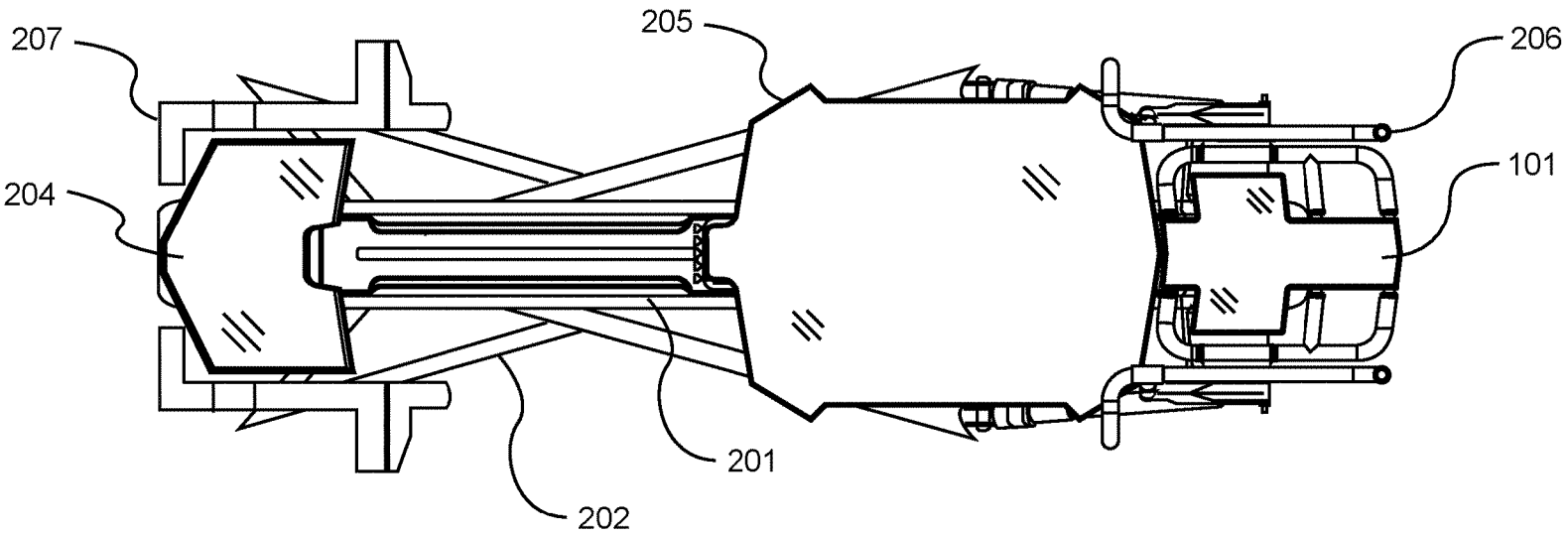
FIG. 3A is an exemplary illustration showing a top view of an exercise machine with a longitudinal end platform.

FIG. 3A is an exemplary illustration showing a top view of an exercise machine 200 with a longitudinal end platform 101, and adjacent and lateral thereto, a pair of back handle assemblies 206. Further, the exercise machine 200 provides for a machine base 202, a longitudinal machine structure 201, and a reciprocating platform 205 movable substantially between the longitudinal end platform 101 and a wide end platform 204 at the opposed end of the machine 200. A pair of front handle assemblies 207 is illustrated as positioned adjacent to the wide end platform 204.

Figure 3B:
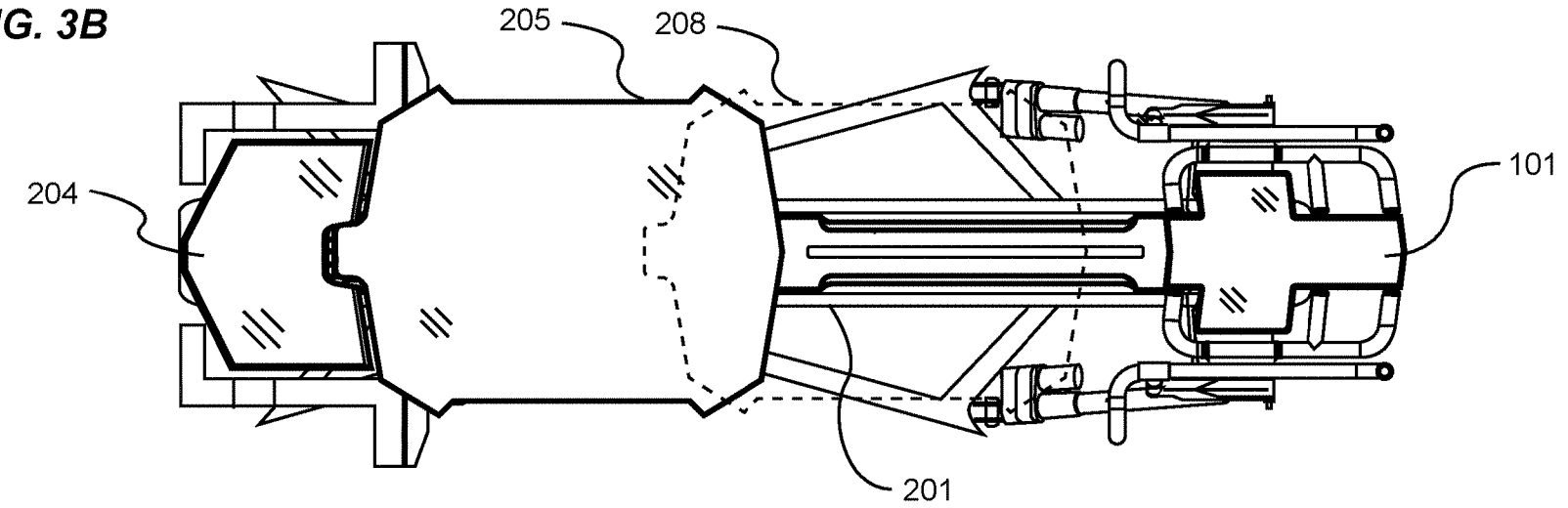
FIG. 3B is an exemplary illustration showing a top view of an exercise machine with a reciprocating platform and a longitudinal end platform.

FIG. 3B is an exemplary illustration showing a top view of an exercise machine 200 with a reciprocating platform 205, a longitudinal machine structure 201, a longitudinal end platform 101, and wide end platform 204 affixed to substantially opposed ends of the machine structure 201. A reciprocating platform outline 208 shown in the drawing as a dashed line is provided to illustrate one of many movable positions of the reciprocating platform.

Figure 4A:
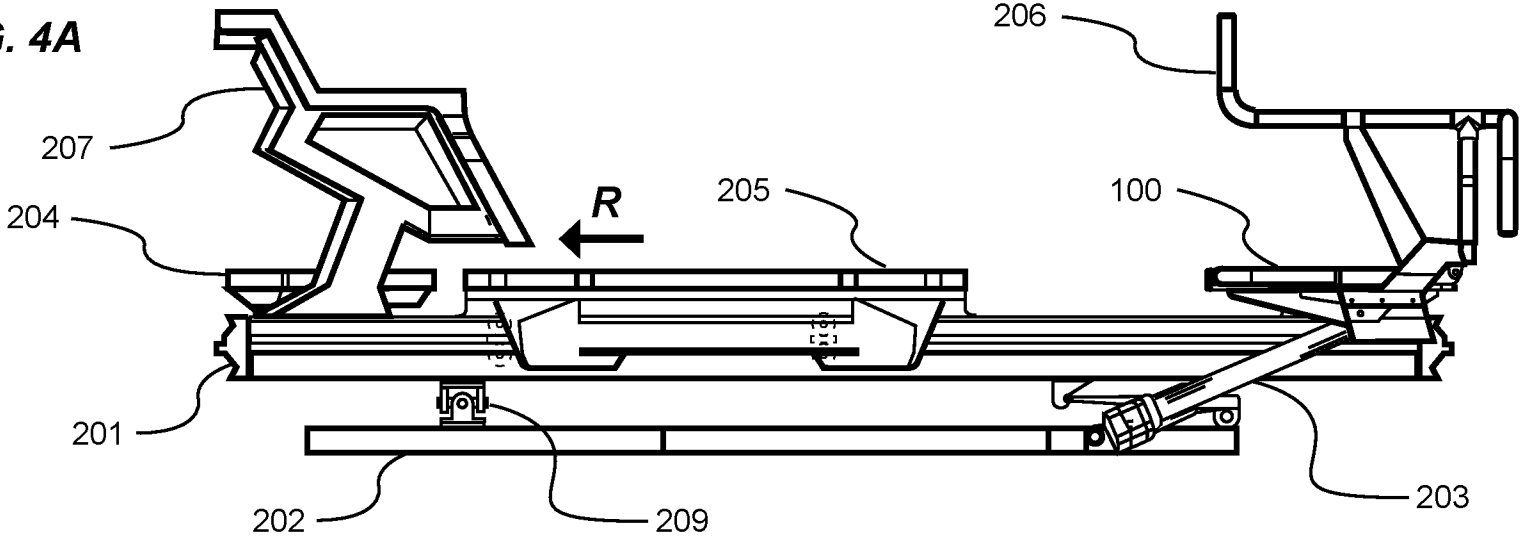
FIG. 4A is an exemplary illustration showing a side view of an exercise machine with a longitudinal end platform.

FIG. 4A is an exemplary illustration showing a side view of an exercise machine with a longitudinal end platform. A machine structure 201 is movably affixed to a machine base 202 by a universal joint 209 and a pair of actuators 203 positioned at mirror image locations on opposed sides transverse to the longitudinal axis of the machine structure 201. A wide end platform 204 is affixed to substantially the front end of the machine structure 201, and a longitudinal end platform assembly 100 is affixed to the opposed end of the machine structure 201.

A reciprocating platform 205 is movable substantially the length of the machine structure 201 between the wide end platform 204 and longitudinal end platform 101. A biasing means not shown but affixed between the reciprocating platform 205 and the machine structure proximal to the wide end platform 204, induces a resistance force R in the direction of the arrow. Exercisers 400 move the reciprocating platform 205 in a direction opposed to the resistance force as a means of exercising. Front handles assemblies 207 and back handle assemblies 206 may be used by exercisers 400 to mount, dismount or exercise upon the machine 200.

Figure 4B:
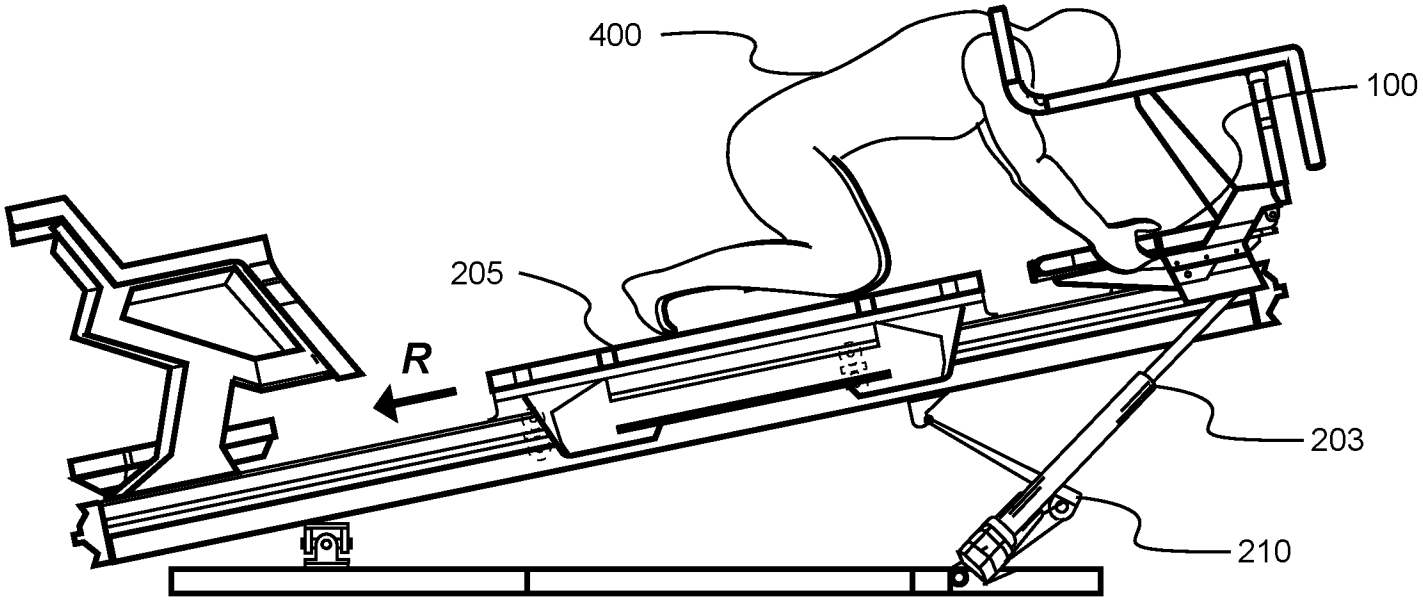
FIG. 4B is an exemplary illustration showing a side view of an exerciser on a tilted exercise machine with a longitudinal end platform.

FIG. 4B is an exemplary illustration showing a side view of an exerciser 400 positioned on a tilted exercise machine 200 gripping the handles of a longitudinal end platform assembly 100. A pair of actuators 203 is shown extended, thereby lifting one end of the machine 200 at an acute angle relative to the horizontal plane. A scissor stabilizer 210 provides for additional stability of the machine structure 201 while elevated. In practice, the exerciser 400 grips the longitudinal end platform assembly 100, and with the knees solidly positioned on the reciprocating platform 205, pulls the platform 101 in a direction opposed to the direction of the resistance bias arrow, with a force exceeding the resistance force R.

Figure 5:
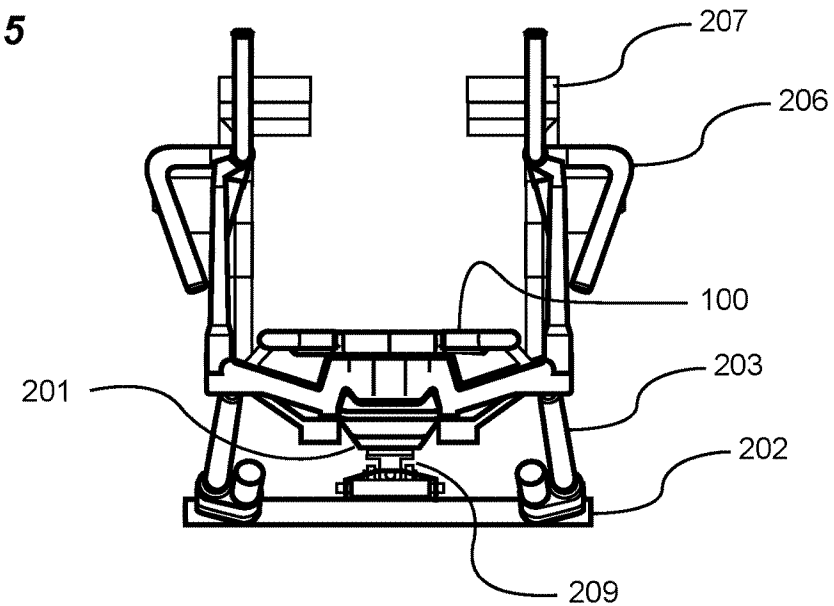
FIG. 5 is an exemplary illustration showing a back view of an exercise machine with a longitudinal end platform.

FIG. 5 is an exemplary illustration showing a back view of an exercise machine 200 with a longitudinal end platform assembly 100 on the proximal end of the machine 200. A pair of back handle assemblies 206 is shown affixed adjacent to and on opposed sides of the longitudinal end platform assembly 100. A machine structure 201 is supported at an elevation above a machine base 202 by means of a pair of actuators 203 on the proximal end of the machine, and a universal joint 209 at a distal position on the machine. A pair of front handle assemblies 207 is shown positioned at the distal end of the exercise machine.

Figure 6:
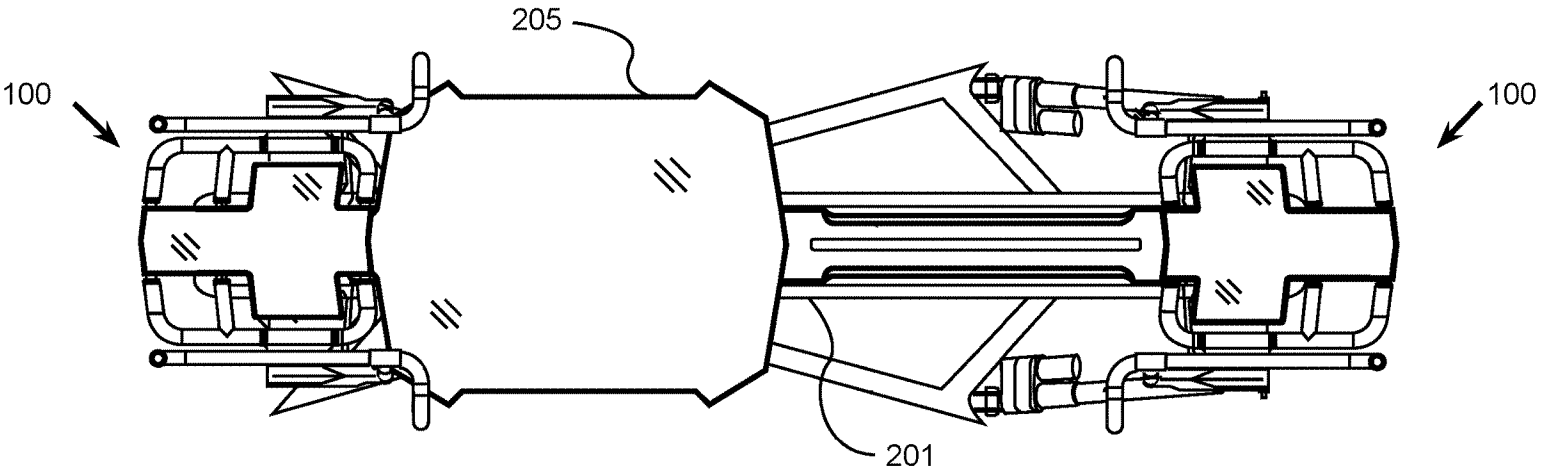
FIG. 6 is an exemplary illustration showing a top view of an exercise machine with a plurality of extended end platforms.

FIG. 6 is an exemplary illustration showing a top view of an exercise machine 200 with two longitudinal end platforms 100 positioned at opposed ends of the machine structure 201. As previously described, a reciprocating platform 205 is movable substantially the distance between the end platforms 100 along a machine structure 201. In the variation of the exercise machine 200 shown, a longitudinal end platform 101 has been affixed to both opposed ends of the machine 200. It should be appreciated that, in some embodiments, the exercise machine 200 may include only a single longitudinal end platform 101 on either of its opposed ends.

Figure 7A:
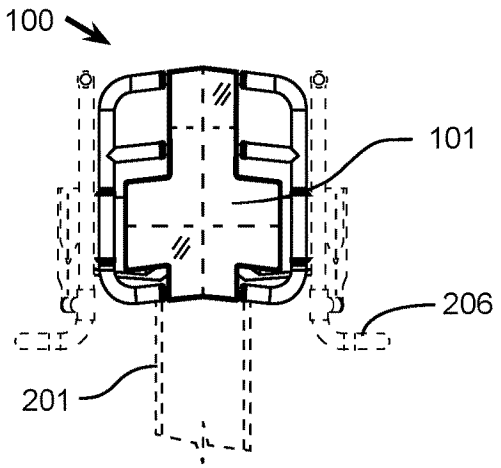
FIG. 7A is an exemplary illustration showing a top view of a longitudinal end platform assembly.

FIG. 7A is an exemplary illustration showing a top view of a longitudinal end platform assembly 100 comprising a longitudinal end platform 101, handles 106, 107, 108, 109, 110, 111, 112 as previously described, and as points of reference, dashed lines to indicate the position of a pair of back handle assemblies 206 and a longitudinal machine structure 201.

Figure 7B:
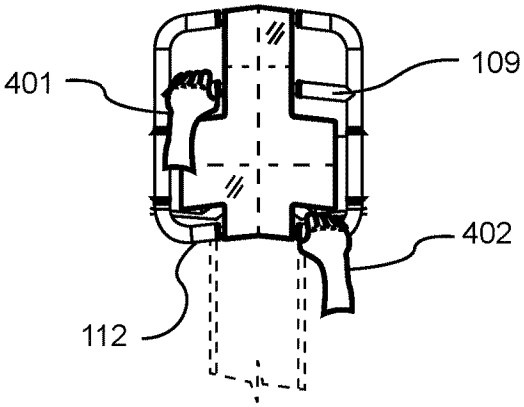
FIG. 7B is an exemplary illustration showing a top view of one variation of hand positioning on a longitudinal end platform.

FIG. 7B is an exemplary illustration showing a top view of one variation of handle 106, 107, 108, 109, 110, 111, 112 positioning on a longitudinal end platform 101. In the drawing, an exerciser 400 is shown positioned for a certain exercise with a left hand 401 gripping a middle transverse handle 109 and a right hand 402 gripping a proximal transverse handle 112.

Figure 7C:
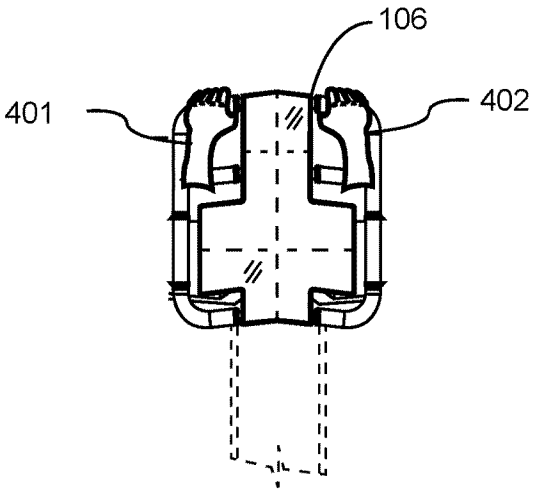
FIG. 7C is an exemplary illustration showing a top view of a another variation of hand positioning on a longitudinal end platform.

FIG. 7C is an exemplary illustration showing a top view of a second variation of hand positioning on a longitudinal end platform 101. In the drawing, an exerciser 400 is shown positioned for a certain exercise with a left hand 401 and right hand 402 gripping their respective left and right distal transverse handles 106.

Figure 7D:
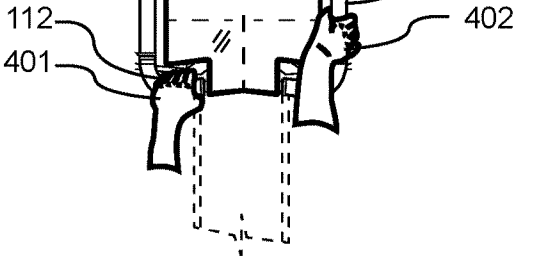
FIG. 7D is an exemplary illustration showing a top view of a another variation of hand positioning on a longitudinal end platform.

FIG. 7D is an exemplary illustration showing a top view of another variation of hand positioning on a longitudinal end platform 101. In the drawing, an exerciser 400 is shown positioned for a certain exercise with a left hand 401 gripping a proximal transverse handle 112 and a right hand 402 gripping a middle side handle 110.

Figure 7E:
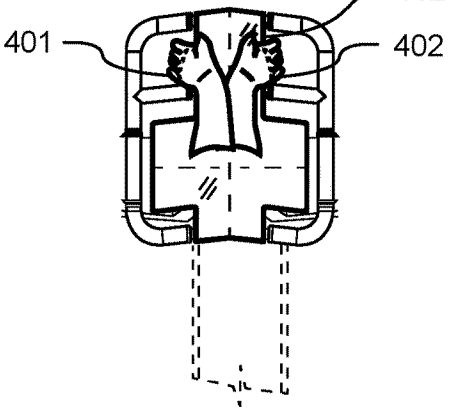
FIG. 7E is an exemplary illustration showing a top view of a another variation of hand positioning on a longitudinal end platform.

FIG. 7E is an exemplary illustration showing a top view of another variation of hand positioning on a longitudinal end platform 101. In the drawing, an exerciser 400 is shown positioned for a certain exercise with a left hand 401 and right hand 402 gripping their respective left and right media gripping surfaces 102.

Figure 7F:
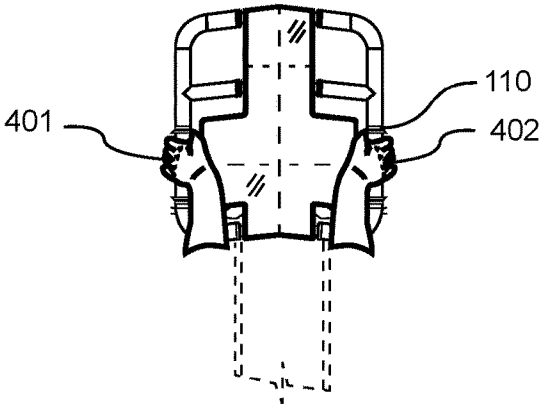
FIG. 7F is an exemplary illustration showing a top view of a another variation of hand positioning on a longitudinal end platform.

FIG. 7F is an exemplary illustration showing a top view of another variation of hand positioning on a longitudinal end platform 101. In the drawing, an exerciser 400 is shown positioned for a certain exercise with a left hand 401 and right hand 402 gripping their respective left and right middle side handles 110.

Figure 7I:
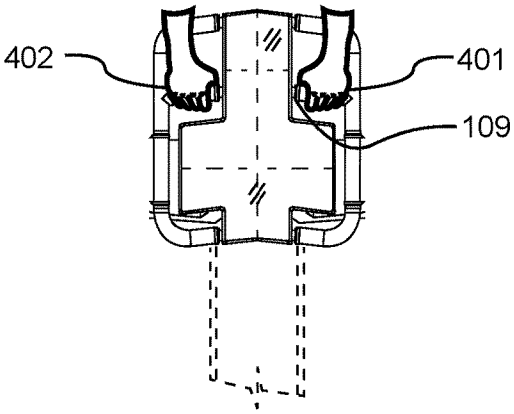
FIG. 7I is an exemplary illustration showing a top view of a another variation of hand positioning on a longitudinal end platform.
Figure 7H:
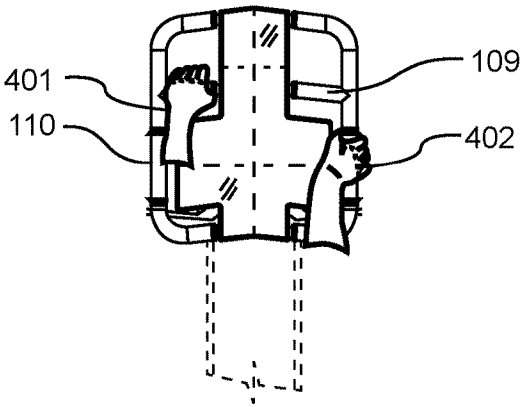
FIG. 7H is an exemplary illustration showing a top view of an another variation of hand positioning on a longitudinal end platform.
Figure 7G:
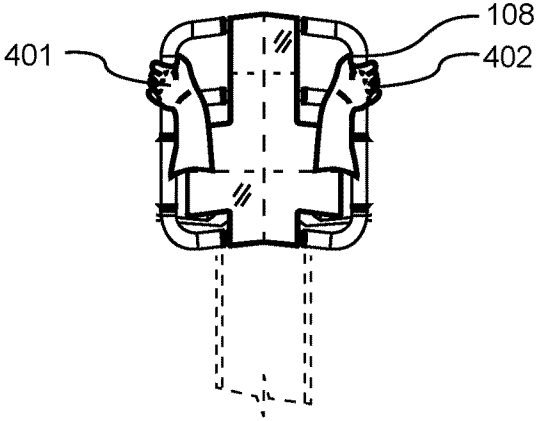
FIG. 7G is an exemplary illustration showing a top view of a yet another variation of hand positioning on a longitudinal end platform.

FIG. 7G is an exemplary illustration showing a top view of another variation of hand positioning on a longitudinal end platform 101. In the drawing, an exerciser 400 is shown positioned for a certain exercise with a left hand 401 and right hand 402 gripping their respective left and right distal side handles 108.

FIG. 7H is an exemplary illustration showing a top view of yet another variation of hand positioning on a longitudinal end platform 101. In the drawing, an exerciser 400 is shown positioned for a certain exercise with a left hand 401 gripping a middle transverse handle 109 and right hand 402 gripping a middle side handle 110.

FIG. 7I is an exemplary illustration showing a top view of another variation of hand positioning on a longitudinal end platform 101. In the drawing, an exerciser 400 is shown positioned for a certain exercise with a left hand 401 gripping a right middle transverse handle 109 and right hand 402 gripping a left middle transverse handle 109. It should be noted that an exerciser 400 performing an exercise with the hands 401, 402 positioned as shown is preferably positioned standing on the floor beyond the distal end of the machine 200, facing back towards substantially the entire exercise machine 200.

Figure 7L:
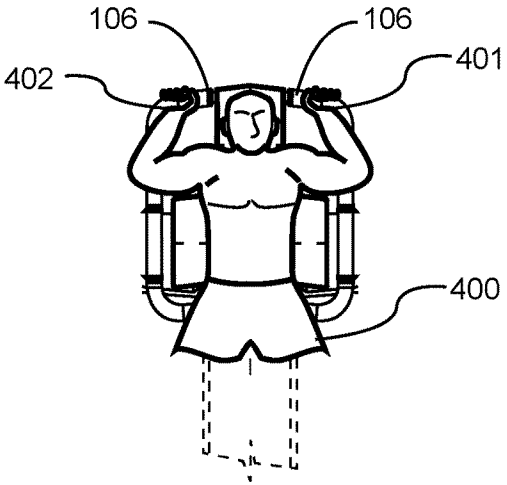
FIG. 7L is an exemplary illustration showing a top view of an exerciser repositioned in the supine position on a resistance exercise machine.
Figure 7K:
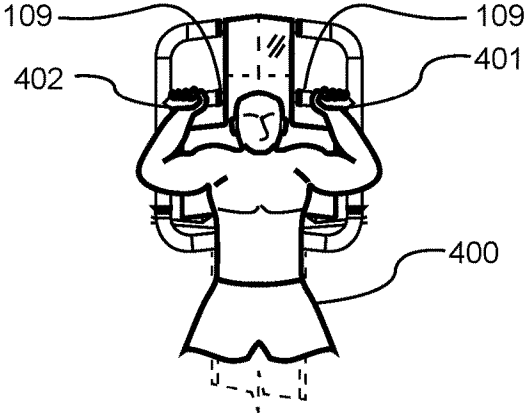
FIG. 7K is an exemplary illustration showing a top view of an exerciser in the supine position on a resistance exercise machine.
Figure 7J:
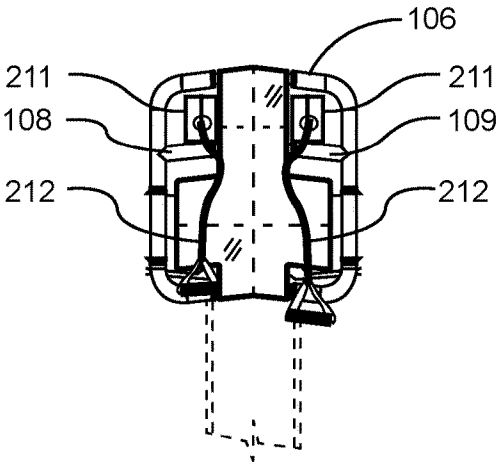
FIG. 7J is an exemplary illustration showing a top view of an accessory attached to a longitudinal end platform.

FIG. 7J is an exemplary illustration showing a top view of an accessory attached to a longitudinal end platform 101. As previously described, the novel longitudinal end platform 101 provides for the removable attachment of various exercise accessories that support the ability to perform an increased scope of exercises upon the machine 200.

Not meant to be limiting to one type of accessory, the drawing shows a pair of resistance training accessories 211 removably affixed to the longitudinal end platform assembly 100 and/or distal end of the machine structure 201 within the open space created between the lateral edges of the longitudinal platform 101, the distal transverse handles 106, middle transverse handles 109 and the distal side handles 108. The accessories just described provide for individual arm resistance training by means of pull cables with handles 212, the cables extendible in opposition to a resistance force from, and retractable back into the resistance training accessories. It should be appreciated that a wide range of accessories may be utilized, and that the description of resistance training accessories 211 is merely for exemplary purposes and should not be construed as limiting in any manner.

FIG. 7K is an exemplary illustration showing a top view of an exerciser 400 in the supine position on a resistance exercise machine 200. It is sometimes preferred to position the upper body in a stationary position upon the longitudinal end platform 101 while using the lower body to exercise against the resistance force provided by the reciprocating platform 205. In the drawing, an exerciser 400 is shown positioned with the upper body in a supine position, with the left and right hands 401, 402 gripping the middle transverse handles 109 for support and stability. As can be readily seen, a substantial portion of the upper body of the exerciser 400 is supported on the longitudinal end platform assembly 100.

FIG. 7L is an exemplary illustration showing a top view of an exerciser 400 repositioned in the supine position on a resistance exercise machine 200. In the variation shown, the exerciser 400 is repositioned closer to the distal end of the platform 101 when compared to the previous position FIG. 7K; with the left and right hands 401, 402 gripping the distal transverse handles 106. Such a position may provide for even more upper body support as may be desired for higher intensity exercising. It should be noted that upper body positioning on the longitudinal end platform 101 is not limited to supine positioning, and that prone or lateral recumbent positions may also be used when performing exercises requiring such body positioning.

Figure 8A:
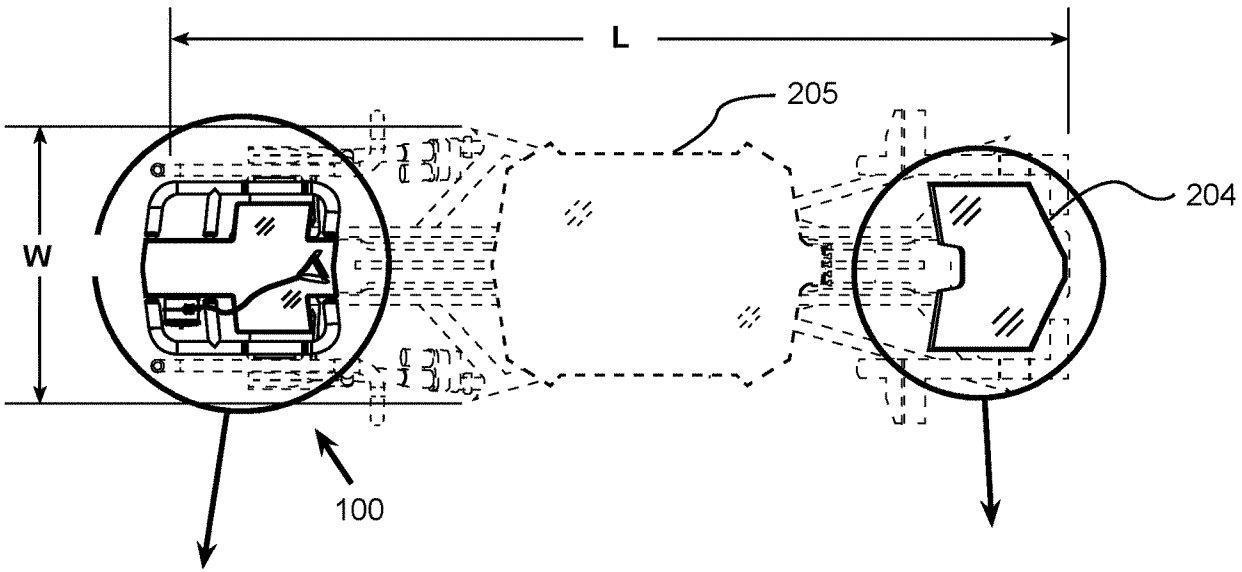
FIG. 8A is an exemplary illustration showing a top view of an exercise machine with a longitudinal end platform.

FIG. 8A is an exemplary illustration showing a top view of an exemplary exercise machine 200 with a longitudinal end platform 101. As shown, the exercise machine 200 may comprise a longitudinal end platform assembly 100 and a wide end platform 204. A dashed line illustrates one position of a reciprocating platform 205. Further, an exercise machine 200 as previously described is shown using dashed reference lines. The exercise machine 200 is may be comprised of a rectilinear geometry with a length L shown being a substantially larger dimension as its width W.

Figure 8B:
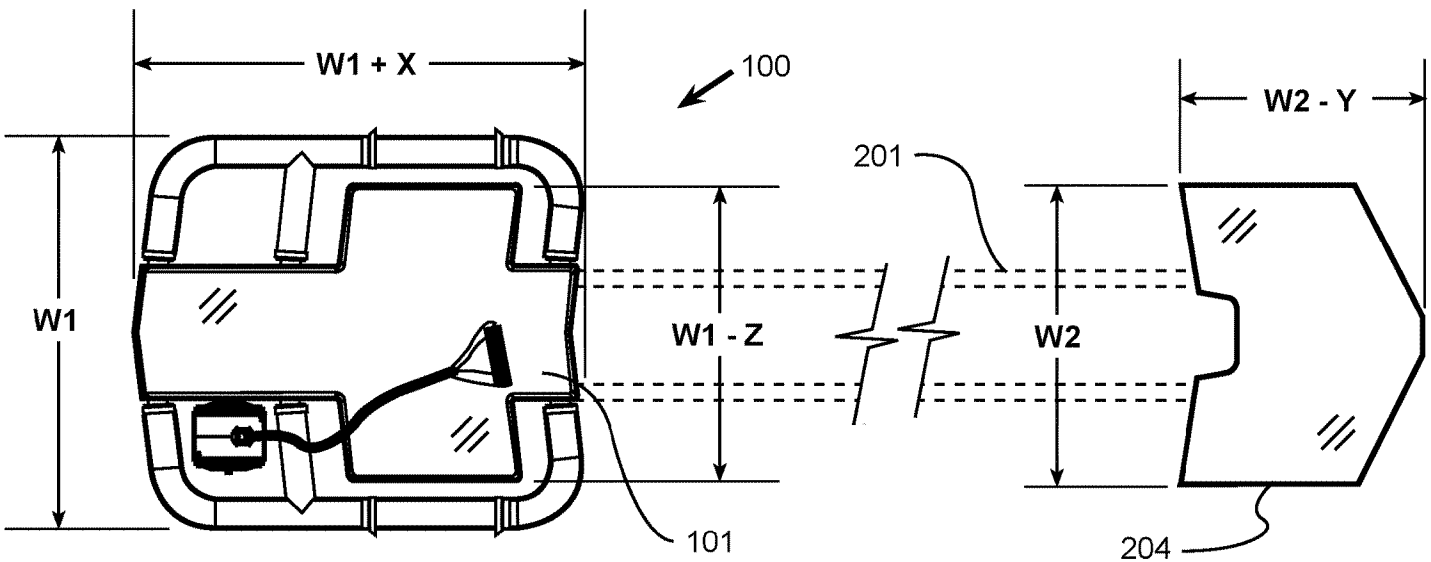
FIG. 8B is an exemplary illustration showing an zoomed-in top view of a longitudinal end platform assembly at one end, and a traditional wide end platform at the opposed end of an exercise machine.

FIG. 8B is an exemplary illustration showing an enlarged top view of a longitudinal end platform assembly 100 and a traditional wide end platform 204 of an exercise machine 200. For reference, a longitudinal machine structure 201 is shown as a broken dashed line, the remainder of the machine 200 being omitted so as to not obscure the description of elements in the drawing.

A traditional end platform of an exercise machine 200 may be described by length and width dimensions; the length being the dimension measured across the platform in a line substantially parallel to the longitudinal axis of the exercise machine and the width being the dimension measured across the platform in a line substantially normal to the longitudinal axis of the machine. In the drawing, the width of the wide end platform 204 is shown with a dimension W2. On the other hand, the length of the wide end platform 204 is shown with a dimension expressed as W2−Y, where W2 is the width of the platform as just described, and Y is a dimension greater than zero. By means of this description which defines traditional machine end platforms, it can be readily understood that the platform 101 is wider than it is long. However, in other embodiments, the reverse could be true, with the platform 101 being longer than it is wide.

An improved longitudinal end platform assembly 100 is shown with an overall width expressed as W1, and the length as measured across the platform assembly 100 in a line substantially parallel to the longitudinal axis of the exercise machine 200 being expressed as W1+X, where X is a dimension greater than zero. By means of this description which defines an improved longitudinal end platform 101, it can be readily understood that the platform assembly 100 that includes handles 106, 107, 108, 109, 110, 111, 112 as shown is longer than it is wide.

Further, the longitudinal platform 101 of the platform assembly 100 is shown with a major length dimension as substantially the same as the major length of the assembly expressed as W1+X, with a major width of the platform 101 being a dimension measured across the platform 101 in a line substantially normal to the longitudinal axis of the machine 200 expressed as W1−Z, where Z is a dimension greater than zero. Therefore, as is shown in the drawing, the longitudinal platform 101, as well as the longitudinal platform assembly 100, both have length dimensions that are greater than their width dimensions.

Figure 9C:
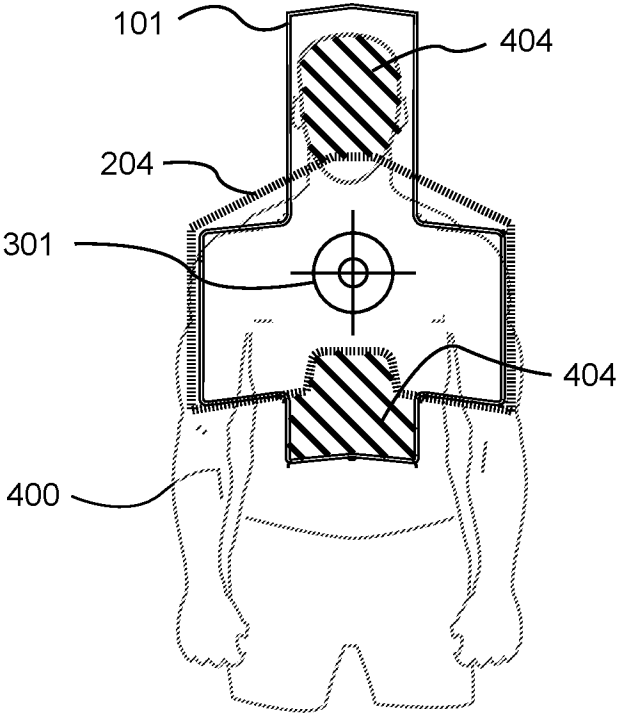
FIG. 9C is an exemplary illustration showing the improved platform-supported area of an exerciser.
Figure 9B:
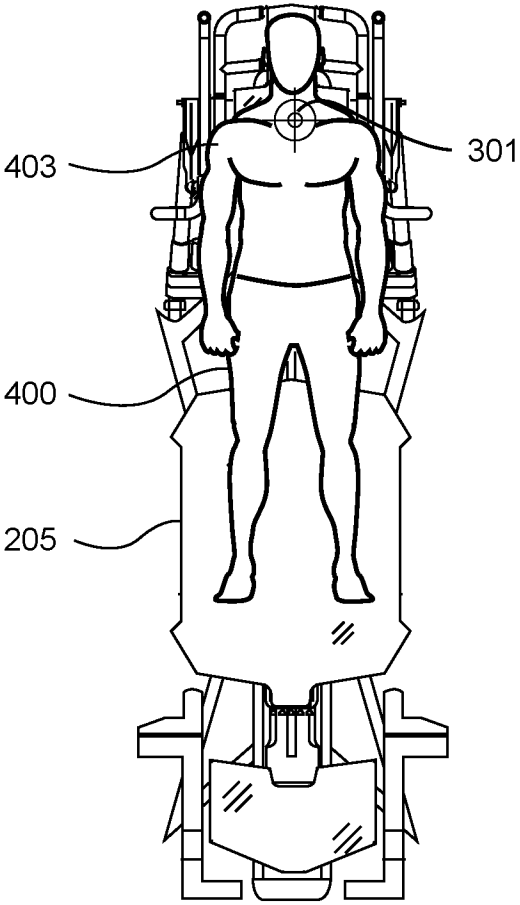
FIG. 9B is an exemplary illustration showing the top view of an exerciser positioned supine on an exercise machine with a longitudinal end platform.
Figure 9A:
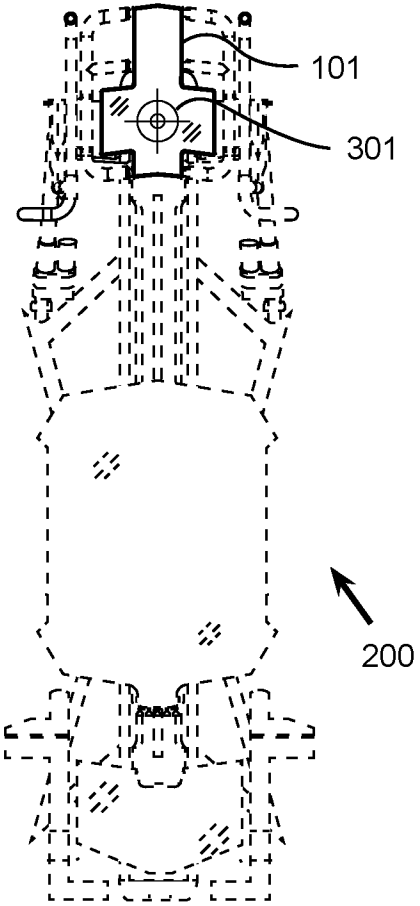
FIG. 9A is an exemplary illustration showing the top view of an exercise machine with a longitudinal end platform.

FIG. 9A is an exemplary illustration showing the top view of an exercise machine 200 with a longitudinal end platform 101. An exercise machine 200 as previously described is shown as dashed lines to prevent obscuring the longitudinal end platform 101 of the longitudinal end platform assembly. A target 301 is shown as a reference point for subsequent discussion.

FIG. 9B is an exemplary illustration showing the top view of an exerciser 400 positioned supine on an exercise machine 200 with the upper body substantially positioned on a longitudinal end platform 101, and the lower body substantially supported by a reciprocating platform 205. As a reference, a target 301 is shown generally over the cervical spine of the exerciser, with the exerciser's shoulders 403 preferably positioned over the major width area of the longitudinal end platform. The longitudinal end platform 101 is partially obscured by the exerciser 400, and is therefore not shown in full.

FIG. 9C is an exemplary illustration showing the platform-supported portions 404 of the upper body of an exerciser 400. As was previously described, a tenet of the Lagree Method of exercising is to maximize spinal alignment and support throughout exercises performed in the machine 200.

For reference purposes, a target 301 is shown to illustrate the approximate cervical spinal area of the exerciser 400 as previously described and referenced. A hash line 204 is shown as the perimeter outline of a wide end platform 204 as previously described, overlaid on the exerciser 400 to illustrate the approximate contact area between the exerciser's 400 back and the wide end platform 204, generally extending from the upper cervical vertebra to the mid thoracic area. It should be noted that this general description may vary depending on the physical size of the exerciser 400.

The perimeter outline of an improved longitudinal end platform 101 is shown as a double line, extending substantially from above the exerciser's 400 head, nearly to the upper lumbar area of the spine. It can be readily seen that the improved longitudinal end platform 101 just described importantly supports the head that was not supported by traditional wide end platforms, and supports a larger portion of the spine, the additional portions of the upper body provided by the improved longitudinal end platform 101 when compared to the traditional wide end platform therefore shown as cross-hatched sections 404.

As illustrated, the end platform 101 may comprise a body portion and a head portion. The body portion may provide support for the body of the exerciser 400, such as the shoulders and upper back. The head portion may provide support for the head of the exercise 400. The body portion of the end platform 101 may be wider than the head portion as shown in the figures. The head portion may extend outwardly from a central point on the end of the body portion so that the head portion is centered with respect to the body portion of the end platform 101.

It should be noted that substantially longitudinal resistance exercise machines 200 providing for a reciprocating platform 205 and one or more end platforms 101, 204 can vary significantly in overall dimensions, and further, exercisers 400 vary significantly in size. The actual dimensions of the longitudinal end platform 101 as described herein are not meant to be limiting. Although the figures illustrate that the length dimension is greater than the width dimension of the end platforms 101, it should be appreciated that other configurations may be utilized.

As can now be appreciated by those skilled in the art, the various embodiments of present invention as described provide for a new and novel exercise machine end platform that provides substantially more exerciser support, and introduce a large number of previously unavailable gripping positions exercisers may use to perform an expanded number of exercises that previously could not be safely performed on an exercise machine with a traditional wide end platform. Further, the longitudinal end platform assembly provides for the attachment of various exercise accessories.

Although specific embodiments have been illustrated and described herein, it will be appreciated by those of ordinary skill in the art that a wide variety of alternate and/or equivalent implementations may be substituted for the specific embodiments shown and described without departing from the scope of the present disclosure. This application is intended to cover any adaptations or variations of the embodiments discussed herein.

What is claimed is:

1. An exercise machine, comprising:

a frame having a first end, a second end opposite of the first end, and a longitudinal axis extending therebetween;

a reciprocating platform movably positioned upon the frame, wherein the reciprocating platform is adapted to be movable along a portion of the longitudinal axis and wherein the reciprocating platform includes an upper surface;

a first tension member connected to the reciprocating platform to provide a tension force to the reciprocating platform;

an end platform attached to the frame, wherein the end platform includes an upper surface, an outer edge, and an inner edge, wherein the inner edge of the end platform faces a direction generally towards the reciprocating platform, wherein the outer edge of the end platform faces a direction generally away from the reciprocating platform;

a plurality of gripping surfaces on the end platform, each of the gripping surfaces being adapted to be grasped by an exerciser to perform various exercises; and a plurality of handles connected to the end platform, each of the handles being adapted to be grasped by the exerciser;

wherein the plurality of gripping surfaces comprises a first medial gripping surface, a second medial gripping surface, a first transverse gripping surface, and a second transverse gripping surface;

wherein the plurality of handles comprises a first distal transverse handle, a second distal transverse handle, a first distal side handle, a second distal side handle, a first middle transverse handle, and a second middle transverse handle;

wherein the first middle transverse handle is parallel to the first transverse gripping surface, wherein the first middle transverse handle faces the first transverse gripping surface;

wherein the second middle transverse handle is parallel to the second transverse gripping surface, wherein the second middle transverse handle faces the second transverse gripping surface;

wherein the first middle transverse handle is connected between the first distal side handle and the first medial gripping surface, wherein the second middle transverse handle is connected between the second distal side handle and the second medial gripping surface;

wherein the first and second medial gripping surfaces are each parallel with respect to the longitudinal axis.

2. The exercise machine of claim 1, wherein the first and second transverse gripping surfaces are each transverse with respect to the longitudinal axis.

3. The exercise machine of claim 2, wherein the first distal transverse handle is connected to the first medial gripping surface and the second distal transverse handle is connected to the second medial gripping surface.

4. The exercise machine of claim 3, wherein the first and second distal transverse handles are each perpendicular with respect to the longitudinal axis.

5. The exercise machine of claim 3, wherein the first and second distal side handles are each parallel with respect to the longitudinal axis.

6. The exercise machine of claim 5, wherein a first space is defined between the first side distal handle and the first medial gripping surface and a second space is defined between the second side distal handle and the second medial gripping surface.

7. The exercise machine of claim 1, further comprising indicia on the upper surface of the end platform.

8. The exercise machine of claim 1, wherein the plurality of gripping surfaces further comprises a first lateral gripping surface and a second lateral gripping surface.

9. The exercise machine of claim 8, wherein the first and second lateral gripping surfaces are each parallel with respect to the longitudinal axis.

10. The exercise machine of claim 9, wherein the plurality of gripping surfaces comprises a first transverse pushing surface and a second transverse pushing surface.

11. The exercise machine of claim 10, wherein the first and second transverse pushing surfaces are each perpendicular with respect to the longitudinal axis.

12. The exercise machine of claim 11, wherein the first medial gripping surface is connected to the first transverse gripping surface, wherein the first lateral gripping surface is connected to the first transverse gripping surface, wherein the first transverse pushing surface is connected to the first lateral gripping surface.

13. The exercise machine of claim 12, wherein the first transverse gripping surface extends at a right angle with respect to the first medial gripping surface, wherein the first lateral gripping surface extends at a right angle with respect to the first transverse gripping surface, wherein the first transverse pushing surface extends at a right angle with respect to the first lateral gripping surface.

14. The exercise machine of claim 11, wherein the end platform comprises a head portion and a body portion, wherein the body portion is wider than the head portion.

15. The exercise machine of claim 14, wherein first and second medial gripping surfaces are on the head portion of the end platform, wherein the first and second transverse gripping surfaces, the first and second lateral gripping surfaces, and the first and second transverse pushing surfaces are each on the body portion of the end platform.

16. The exercise machine of claim 11, wherein the plurality of handles further comprises a first distal corner handle connected between the first distal transverse handle and the first distal side handle and a second distal corner handle connected between the second distal transverse handle and the second distal side handle.

17. The exercise machine of claim 16, wherein the plurality of handles further comprises a first middle side handle connected to the first distal side handle and a second middle side handle connected to the second distal side handle.

18. An exercise machine, comprising:

a frame having a first end, a second end opposite of the first end, and a longitudinal axis extending therebetween;

a reciprocating platform movably positioned upon the frame, wherein the reciprocating platform is adapted to be movable along a portion of the longitudinal axis and wherein the reciprocating platform includes an upper surface;

a first tension member connected to the reciprocating platform to provide a tension force to the reciprocating platform;

an end platform attached to the frame, wherein the end platform includes an upper surface, an outer edge, and an inner edge, wherein the inner edge of the end platform faces a direction generally towards the reciprocating platform, wherein the outer edge of the end platform faces a direction generally away from the reciprocating platform;

a plurality of gripping surfaces on the end platform, each of the gripping surfaces being adapted to be grasped by an exerciser to perform various exercises; and a plurality of handles connected to the end platform, each of the handles being adapted to be grasped by the exerciser;

wherein the plurality of gripping surfaces comprises a first medial gripping surface, a second medial gripping surface, a first transverse gripping surface, and a second transverse gripping surface;

wherein the plurality of handles comprises a first distal transverse handle, a second distal transverse handle, a first distal side handle, a second distal side handle, a first middle transverse handle, and a second middle transverse handle;

wherein the plurality of gripping surfaces further comprises a first lateral gripping surface and a second lateral gripping surface;

wherein the first and second lateral gripping surfaces are each parallel with respect to the longitudinal axis;

wherein the plurality of gripping surfaces comprises a first transverse pushing surface and a second transverse pushing surface;

wherein the first and second transverse pushing surfaces are each perpendicular with respect to the longitudinal axis;

wherein the plurality of handles further comprises a first distal corner handle connected between the first distal transverse handle and the first distal side handle and a second distal corner handle connected between the second distal transverse handle and the second distal side handle;

wherein the plurality of handles further comprises a first middle side handle connected to the first distal side handle and a second middle side handle connected to the second distal side handle;

wherein the plurality of handles further comprises a first proximal corner handle connected to the first middle side handle, a second proximal corner handle connected to the second middle side handle, a first proximal transverse handle connected between the first proximal corner handle and the end platform, and a second proximal transverse handle connected between the second proximal corner handle and the end platform.

* * * * *